US008317523B2

(12) United States Patent
Blakborn et al.

(10) Patent No.: US 8,317,523 B2
(45) Date of Patent: Nov. 27, 2012

(54) PLUG CONNECTOR FOR CIRCUIT BOARDS

(75) Inventors: Willem Blakborn, Inzell (DE); Martin Zebhauser, Laufen (DE); Ulrich Kobele, Aufham (DE)

(73) Assignee: Rosenberger Hochfrequenztechnik GmbH & Co, KG, Fridolfing (DE)

( * ) Notice: Subject to any disclaimer, the term of this patent is extended or adjusted under 35 U.S.C. 154(b) by 0 days.

(21) Appl. No.: 13/126,801

(22) PCT Filed: Oct. 26, 2009

(86) PCT No.: PCT/EP2009/007651

§ 371 (c)(1),
(2), (4) Date: Apr. 29, 2011

(87) PCT Pub. No.: WO2010/060511

PCT Pub. Date: Jun. 3, 2010

(65) Prior Publication Data

US 2011/0207345 A1 Aug. 25, 2011

(30) Foreign Application Priority Data

Nov. 3, 2008 (DE) ..... 20 2008 014 542 U

(51) Int. Cl.
*H01R 12/00* (2006.01)

(52) U.S. Cl. ..... 439/63; 439/79; 439/581

(58) Field of Classification Search ..... 439/63, 439/78, 79, 579, 581
See application file for complete search history.

(56) References Cited

U.S. PATENT DOCUMENTS

| | | | | |
|---|---|---|---|---|
| 4,991,988 | A * | 2/1991 | Snell et al. | 401/111 |
| 5,215,470 | A | 6/1993 | Henry | |
| 5,405,267 | A | 4/1995 | Koegel | |
| 5,478,258 | A * | 12/1995 | Wang | 439/581 |
| 6,358,062 | B1 * | 3/2002 | Feldman et al. | 439/63 |
| 6,468,089 | B1 * | 10/2002 | Hubbard et al. | 439/63 |
| 6,478,587 | B2 * | 11/2002 | Sharples | 439/131 |
| 7,234,967 | B2 * | 6/2007 | Weidner et al. | 439/581 |
| 7,766,696 | B2 * | 8/2010 | Conner et al. | 439/581 |
| 8,105,092 | B2 * | 1/2012 | Weidner et al. | 439/65 |
| 2005/0221673 | A1 | 10/2005 | Myer | |
| 2011/0207345 | A1 * | 8/2011 | Blakborn et al. | 439/78 |

FOREIGN PATENT DOCUMENTS

| | | | |
|---|---|---|---|
| DE | 4312091 | A1 | 10/1993 |
| DE | 19720678 | C1 | 10/1998 |
| EP | 0936702 | A | 8/1999 |
| EP | 1109259 | A | 6/2001 |

* cited by examiner

*Primary Examiner* — James Harvey

(74) *Attorney, Agent, or Firm* — DeLio & Peterson, LLC; Robert Curcio

(57) ABSTRACT

A multiple plug connector for a printed circuit board having a mounting part and at least two contact parts which each have a plug part for plug-connection to a complementary plug part of a plug connector, wherein an opening is formed for each contact part and each contact part passes through one of the openings by way of the plug part and is mechanically fixed to the mounting part. Each contact part has, on a side facing the printed circuit board, at least one contact element for electrical contact with a conductor of the printed circuit board. The mounting part has at least one first contact for electrical contact to at least one contact element of a contact part, and at least a second contact electrically connected to at least one first contact device for electrical contact with a conductor on the printed circuit board.

27 Claims, 3 Drawing Sheets

PLUG CONNECTOR FOR CIRCUIT BOARDS

This application is a National Stage filing based on PCT/EP2009/007651, filed Oct. 26, 2009, and which claims priority to German Patent Application No. DE 20 2008 014 542.2, filed Nov. 3, 2008.

BACKGROUND OF THE INVENTION

1. Field of the Invention

The present invention relates to a multiple plug-in connector for printed circuit boards for fastening to a printed circuit board, having a mounting part and having at least two contact sections which each have a plug-in part for connection by plugging-in to a complementary mating part of a plug-in connector, an opening being formed for each contact section in the mounting part and each contact section passing through one of the openings by its plug-in part and being fastened to the mounting part mechanically, each contact section having, on a side adjacent the printed circuit board, at least one contact member for making electrical contact with a conductor on the printed circuit board. The invention also relates to a printed circuit board having an electronic circuit and having a multiple plug-in connector for printed circuit boards which is arranged on the printed circuit board and which is electrically connected to the electronic circuit.

2. Description of Related Art

Known from DE 43 12 091 A1 is a plug-in connector for printed circuit boards which has a slotted opening, thus enabling a flat, planar region of a printed circuit board, which carries conductors, to be inserted in this opening. Extending along the region carrying the conductors are a plurality of parallel conductors which come from a printed circuit on the printed circuit board.

Known from DE 197 20 678 C1 is a RF co-axial plug-in connector part for mounting in a fixed position on a printed circuit board. Arranged on a metal housing of the RF co-axial plug-in connector part are solder pins and a metal plug-in part in the form of, as the case may be, a co-axial plug or co-axial socket. When the housing is fitted down onto a printed circuit board by its underside, the solder pins engage in electrical connections associated with them on the printed circuit board, these electrical connections taking the form of contact-making mounting holes into which the solder pins are soldered. To enable a plurality of such RF co-axial plug-in connector parts to be incorporated into a component, there is known from DE 198 05 944 C1 a connector strip which has a plurality of receiving openings. Angled co-axial plug-in connectors are inserted in respective ones of the receiving openings by their plug-in parts and are held mounted by the connector strip. The RF plug-in connectors are usually first inserted in the connector strip and the connector strip is then fitted down on the printed circuit board, thus causing the solder pins of all the RF plug-in connectors to engage in corresponding mounting holes in the printed circuit board and causing soldering faces on all the RF plug-in connectors to be arranged against corresponding solder pads on the printed circuit board. However, a problem arises in this case, which is that the solder pins of the plurality of RF plug-in connectors mounted in the connector strip have to be aligned in exact positions so that they will engage in their respective mounting holes simultaneously when the connector strip is fitted down. At the soldering faces on the plurality of RF plug-in connectors mounted in the connector strip, the additional problem arises that these need to be arranged not only in an exact position but also as exactly as possible in the plane of the printed circuit board. This makes the fitting of the RF plug-in connectors to the connector strip time-consuming and cost-intensive.

SUMMARY OF THE INVENTION

Bearing in mind the problems and deficiencies of the prior art, it is therefore an object of the present invention to simplify a multiple plug-in connector for printed circuit boards of the above kind and a printed circuit board of the above kind with regard to the fitting process and at the same time to improve their electrical characteristics.

This object is achieved in accordance with the invention by a multiple plug-in connector for printed circuit boards, and by a printed circuit board, of the above kind which have the features described in the claims.

Still other objects and advantages of the invention will in part be obvious and will in part be apparent from the specification.

The above and other objects, which will be apparent to those skilled in the art, are achieved in the present invention which is directed to a multiple plug-in connector for printed circuit boards for fastening to a printed circuit board, including a mounting part and having at least two contact sections which each including a plug-in part for connection by plugging-in to a complementary mating part of a plug-in connector, an opening being formed for each contact section in the mounting part and each contact section passing through one of the openings by its plug-in part and being fastened to the mounting part mechanically, each contact section having, on a side adjacent the printed circuit board, at least one contact member (for making electrical contact with a conductor on the printed circuit board, the mounting part including at least one first contact device which is so arranged and formed that the first contact device makes electrical contact with at least one contact member of a contact section, the mounting part including at least one second contact device which is electrically connected to at least one first connecting device and which is designed to make electrical contact with a conductor on the printed circuit board, such that the second contact device of the mounting part is so arranged and formed that the second contact device makes electrical contact with that conductor on the printed circuit board which has to be electrically connected to that contact member of the contact section which is electrically connected to that first contact device which is electrically connected to the second contact device.

The contact section may comprise an RF plug-in connector having an outer conductor and a center conductor, at least one contact member of the contact section including an outer-conductor contact and at least one other contact member of the contact section including a center-conductor contact.

The first contact device of the mounting part is electrically connected to all the outer-conductor contacts of the contact sections, and the second contact device, which is connected to the first contact device, is in electrical communication with an outer conductor on the printed circuit board. The first contact device may include a clamped contact, and the contact areas of the clamped contact may be coated with nickel. The second contact device of the mounting part may include a plurality of individual elevations which are formed on the side of the mounting part adjacent the printed circuit board and spaced apart from one another. The contact areas of the second contact device of the mounting part may have a finish of tin.

The mounting part may comprise a stamped/punched and bent part, and may be a zinc die casting.

The first or second contact device, or both, of the mounting part are integral with the mounting part. Furthermore, the mounting part may comprise, on a side adjacent the printed circuit board, at least one pin which projects from this side, to engage in a corresponding mounting opening in the printed circuit board and to make a mechanical, electrical, or mechanical and electrical connection to the printed circuit board.

In a second aspect, the present invention is directed to a printed circuit board having an electronic circuit and having a multiple plug-in connector for printed circuit boards which is arranged on the printed circuit board and which is electrically connected to the electronic circuit, wherein the multiple plug-in connector is designed as defined herein.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
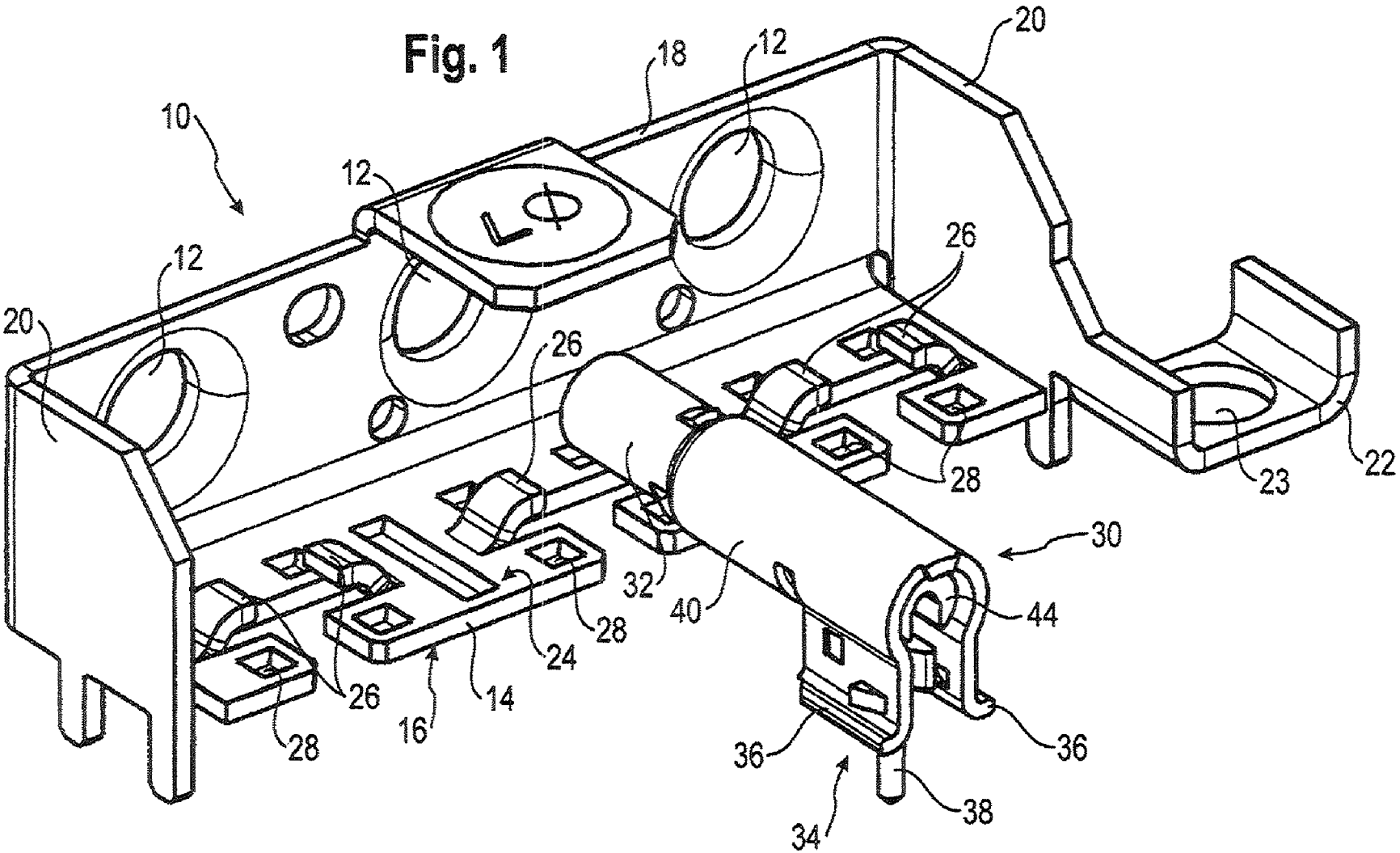
FIG. 1 is a perspective view showing a preferred embodiment of multiple plug-in connector for printed circuit boards according to the invention when it has an as yet unassembled mounting part.

In describing the preferred embodiment of the present invention, reference will be made herein to FIGS. 1-3 of the drawings in which like numerals refer to like features of the invention.

In a multiple plug-in connector for printed circuit boards of the above kind, provision is made in accordance with the invention for the mounting part to have at least one first contact device which is so arranged and formed that the said first contact device makes electrical contact with at least one contact member of a contact section, the mounting part having at least one second contact device which is electrically connected to at least one first connector and which is designed to make electrical contact with a conductor on the printed circuit board.

This has the advantage that the function by which the contact section makes electrical and mechanical contact with the printed circuit board is decoupled from the contact members of the contact section, thus making the plugging-in function and the making of electrical contact functionally separate from one another. In this way, the requirement for contacts which are to be electrically connected to the printed circuit board to be exactly positioned is shifted to the mounting part, where it is easier to satisfy than at the contact members of the contact sections. In other words, the mounting part makes electrical contact between a contact member of a contact section and a conductor on the printed circuit board, which means that there is no longer any need for direct electrical contact to be made between the said contact member of the contact section and the conductor on the printed circuit board. Exact positioning of this contact member of the contact section is no longer necessary, because the function of making electrical contact for this one contact element or the plurality of contact elements is taken over by the mounting part.

The second contact device of the mounting part is usefully so arranged and formed that the said second contact device makes electrical contact with that conductor on the printed circuit board which has to be electrically connected to that contact member of the contact section which is electrically connected to that first contact device which is electrically connected to the said second contact device.

In a preferred embodiment, the contact section takes the form of an RF plug-in connector having an outer conductor and a center conductor, at least one contact member of the contact section taking the form of an outer-conductor contact and at least one other contact member of the contact section taking the form of a center-conductor contact. In this case, the first contact device of the mounting part is preferably electrically connected to all the outer-conductor contacts of the contact sections and the second contact device, which is electrically connected to the first contact device, is designed to make electrical contact with an outer conductor, i.e. an earth conductor, on the printed circuit board.

Manufacture and assembly which are particularly easy and inexpensive with, at the same time, a standard of contact for radio-frequency applications which is high and reliably repeatable can be achieved by having the first contact device take the form of a clamped contact. Electrical contact of a particularly high standard can be achieved by coating the contact areas of the clamped contact with nickel.

Defined and locally confined points of contact between the conductors on the printed circuit board and the second contact device of the mounting part and a corresponding predetermined path of flow for a flow of current are obtained by causing the second contact device of the mounting part to have a plurality of individual elevations which are formed on the side of the mounting part adjacent the printed circuit board in such a way as to be spaced apart from one another.

Contact areas between the mounting part and the printed circuit board which can be soldered particularly well are obtained by causing contact areas of the second contact device of the mounting part to have a finish of tin.

In a preferred embodiment, the mounting part takes the form of a stamped/punched and bent part.

In an alternative embodiment, the mounting part takes the form of a zinc die casting.

The first and/or second contact devices of the mounting part are usefully formed in one piece with the mounting part.

In a preferred embodiment, the mounting part has, on a side adjacent the printed circuit board, at least one pin which projects from this side, to engage in a corresponding mounting opening in the printed circuit board and to make a mechanical and/or electrical connection to the printed circuit board.

To secure the mounting part mechanically to the printed circuit board to an additional degree, the mounting part has a fastening portion to connect the mounting part mechanically to the printed circuit board. The fastening portion has for example an opening which is designed to have a screw screwed into the printed circuit board pass through it.

In a printed circuit board of the above kind, provision is made in accordance with the invention for the multiple plug-in connector for printed circuit boards to be designed as described above.

This has the advantage that the function by which the contact section makes electrical and mechanical contact with the printed circuit board is decoupled from the contact members of the contact section, thus making the plugging-in function and the making of electrical contact functionally separate from one another. In this way, the requirement for contacts which are to be electrically connected to the printed circuit board to be exactly positioned is shifted to the mounting part, where it is easier to satisfy than at the contact members of the contact sections.

The multiple plug-in connector for printed circuit boards is usefully screwed solidly to the printed circuit board.

Figure 2:
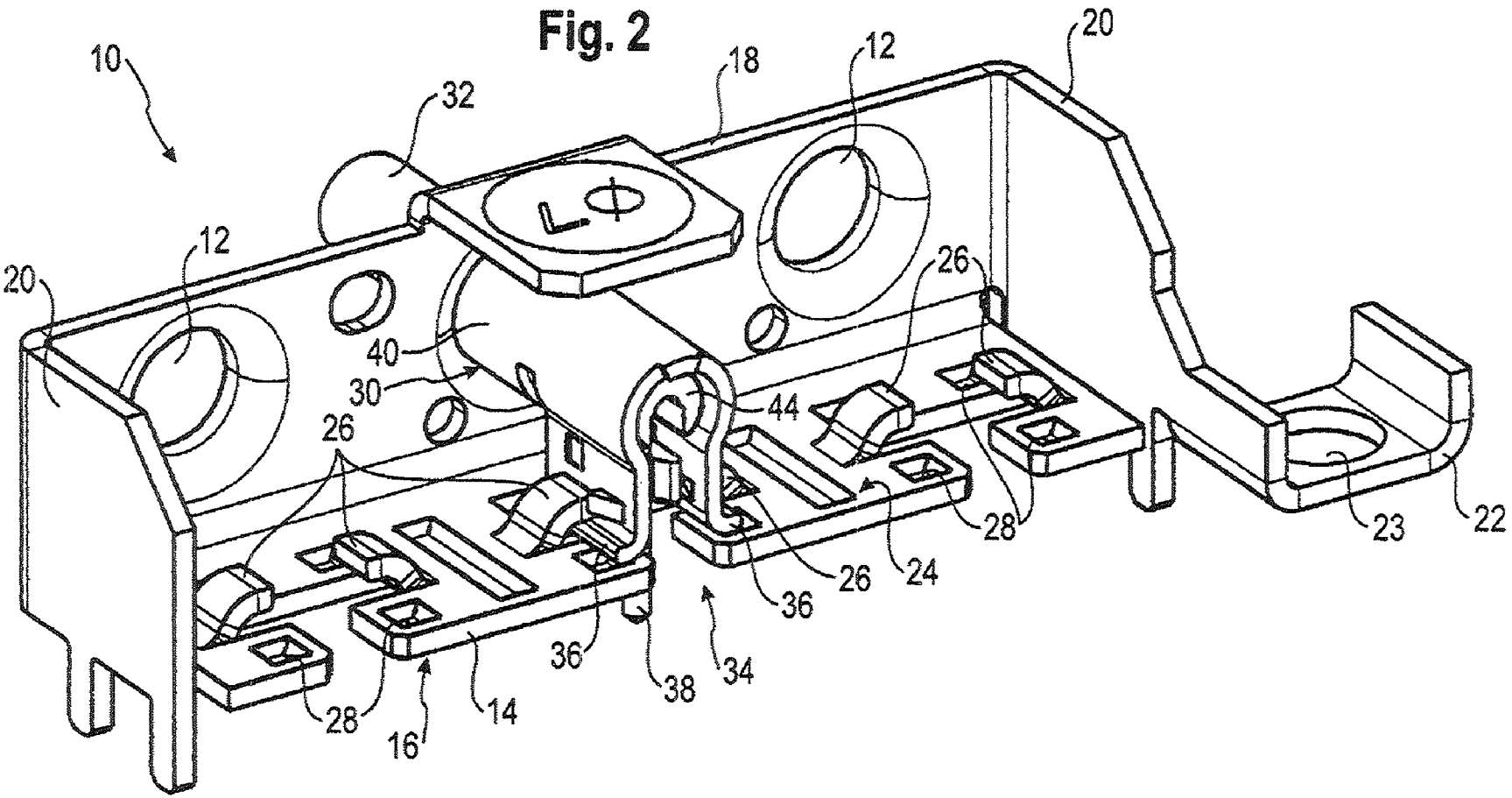
FIG. 2 is a perspective view showing the preferred embodiment of multiple plug-in connector for printed circuit boards shown in FIG. 1 when it has a mounting part which has been assembled.
Figure 3:
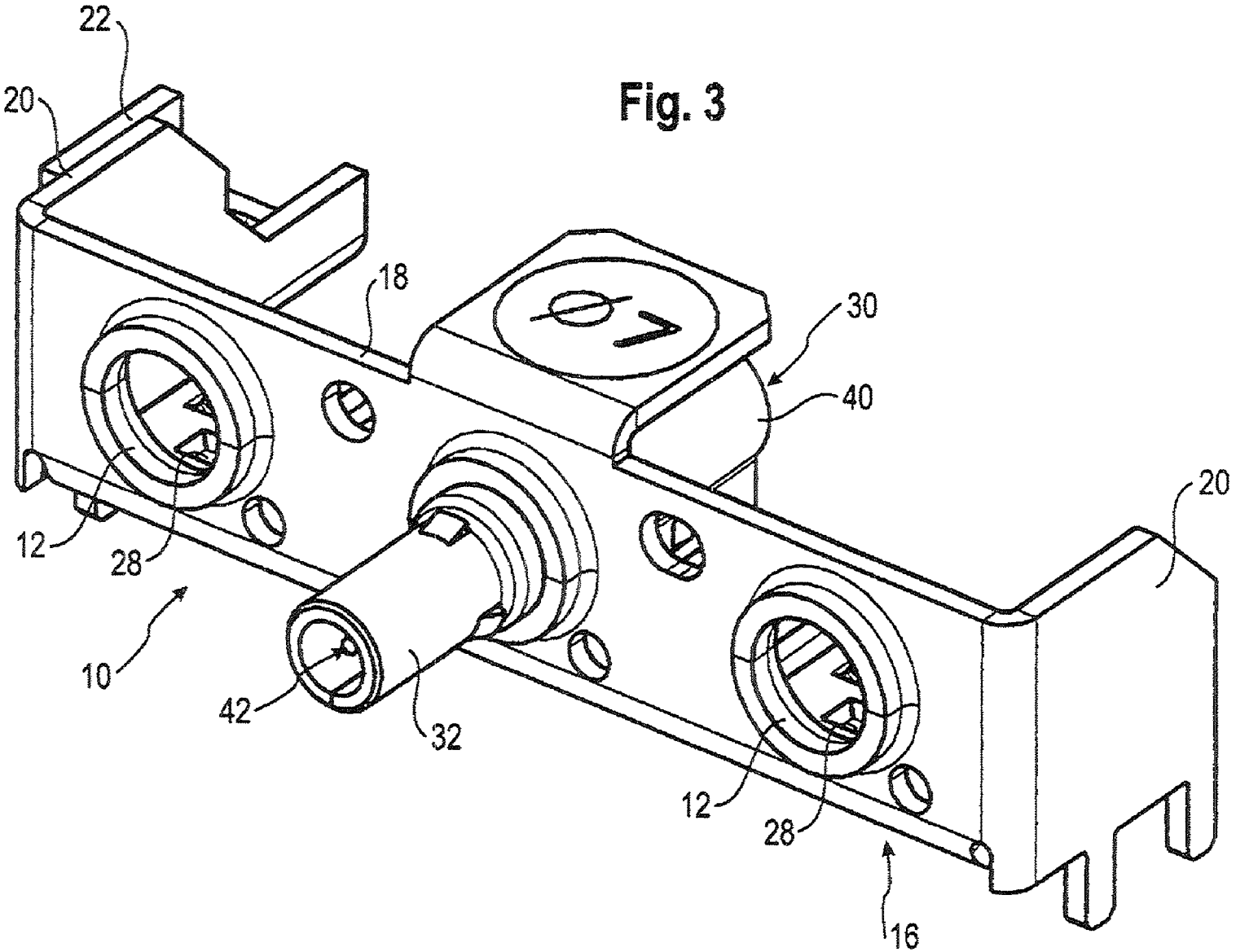
FIG. 3 is a perspective view showing the preferred embodiment of multiple plug-in connector for printed circuit boards shown in FIG. 1 when it has a mounting part which has been assembled.

The preferred embodiment of a multiple plug-in connector for printed circuit boards according to the invention which is shown in FIGS. 1 to 3, for fastening to a printed circuit board (not shown), comprises a mounting part 10 which has three openings 12, a first wall 14 which has a printed-circuit-board side 16 adjacent the printed circuit board, and a second wall 18 in which the openings 12 are formed. The mounting part 10 also has side-pieces 20 which are arranged perpendicularly to the first wall 14 and the second wall 18. There is formed on one side-piece 20 a fastening portion 22 which has an opening 23 for connecting the mounting part 10 mechanically to the printed circuit board, by means of a screwed connection for example. On a contact-section side 24 of the first wall 14 which is opposite from the printed-circuit-board side 16 are formed first contact devices in the form of lugs 26 which rise up in an arched shape. Formed on the printed-circuit-board side 16 of the first wall 14 are second contact devices in the form of contact areas 28 which project towards the printed circuit board. When the mounting part 10 is fitted onto the printed circuit hoard, these contact areas 28 come to rest on corresponding contact pads on the printed circuit board and are connected to the said contact pads electrically by means of a soldered connection. The mounting part is so designed that all the contact areas 28 are within one common plane to within a tolerance of less than 100 μm. It is ensured in this way that all the contact areas 28 will make uniform contact with the contact pads on the printed circuit board. The mounting part 10, and the contact area 28 and lugs 26 which rise in an arched shape, all of which are formed on the mounting part 10 in one piece therewith, are entirely formed from an electrically conductive material, and there is thus an electrically conductive connection between all the lugs 26 which rise in an arched shape and all the contact areas 28.

The multiple plug-in connector for printed circuit boards which is shown by way of example also comprises three contact sections 30, of which only one is shown for reasons of clarity. The contact sections 30 take the form of RF plug-in connectors each having a plug-in part 32 for connecting by plugging-in to a complementary mating part (not shown) of a plug-in connector (not shown). Each plug-in part 32 is designed to engage in one of the openings 12, as shown in FIG. 2. The contact sections 30 are pressed into openings 12 by their respective plug-in parts 32.

Each contact section 30 also has a side 34 adjacent the printed circuit board on which are arranged contact members 36, 38. In the embodiment which is shown by way of example, a first contact member 36 takes the form of an outer-conductor contact and a second contact member 38 takes the form of a center-conductor contact. The center-conductor contact 38 takes the form of a pin which extends towards the printed circuit board beyond the first wall 14 of the mounting part 10 and which, when the mounting part 10 has been fitted down onto the printed circuit board, engages in a corresponding mounting opening in the printed circuit board and is electrically connected there to a signal conductor on the printed circuit board, by soldering for example. This center-conductor contact 38 is electrically connected to a center-conductor part 42 (FIG. 3) of the contact section 30, this center-conductor part extending into the plug-in part 32 and being held inside an outer-conductor part 40 of the contact section 30 by means of an insulator 44 (FIGS. 1 and 2). The outer-conductor contact 36 is electrically connected to the outer-conductor part 40 and is designed to fit under the arched lugs 26. As can be seen from FIG. 2, the outer-conductor contacts 36 of the contact section 30 can be slid under the free ends of the arched lugs 26, thus causing clamped electrical contact to be made between the outer-conductor contacts 36 of the contact section 30 and the arched lugs 26. An electrically conductive connection between the outer-conductor contacts 36 of the contact section 30 and the contact areas 28 on the first wall 14 of the mounting part 10 is thus made at the same time via the electrically conductive mounting part 10.

The first wall 14 is made of an electrically conductive material and the arched lugs 26 are thus electrically connected to the contact areas 28. In this way, the first wall 14 makes, via the arched lugs 26 and the contact areas 28, electrical contact between the outer-conductor contacts 36 and corresponding earth conductors on the printed circuit board, with which earth conductors the contact areas 28 make electrical contact. In other words, this electrical contact by the outer-conductor contacts 36 of the contact sections 30 no longer has to be made directly on the side 34 of the contact sections which is adjacent the printed circuit board and instead it is the mounting part 10 which takes over the making of this electrical contact. This does away with the need for those sides 34 of adjoining contact sections 30 which are adjacent the printed circuit board to be aligned in a plane to an accuracy of 0.1 mm.

The mounting part 10 takes the form of a one-piece stamped/punched and bent part having a finish of tin. This allows the contact areas 28 to be soldered well to corresponding contact pads on the printed circuit board. The contact section 30, or rather the outer-conductor part 40 and the center-conductor part 42, on the other hand are preferably formed to have a finish of nickel, thus resulting at the plug-in part 32 in good electrical contact with the complementary mating connector with low insertion forces. Because what occurs at the points of electrical and mechanical contact between the outer-conductor contact 36 and the lugs 26 which rise in an arch is clamped contact and not soldered contact, the nickel finish on the contact section 30, which is difficult to solder, is not a disadvantage.

This multiple plug-in connector for printed circuit boards, or printed circuit board connector, according to the invention thus separates the connecting interface at the plug-in part 32 functionally from the soldered electrical connection of the outer conductor 40 to corresponding earth conductors on the printed circuit board. This makes it possible for different coatings to be used for the connecting interface at the plug-in part 32 on the one hand and the soldered electrical connection of the outer conductor 40 to corresponding earth conductors on the printed circuit board on the other hand. The multiple plug-in connector for printed circuit boards according to the invention can be fitted out in a variety of ways, i.e. the three contact sections 30 need not necessarily be of identical forms. The system is particularly suitable for single, double, treble and quadruple PCB connectors. Stand-off planarity for the outer-conductor contacts can easily be obtained to within 0.1 mm even in multiple plug-in connectors because the electrical contacts in question are made by the contact areas 28 of the mounting part 10 and not directly by the outer-conductor contacts 36 on that side 34 of the contact sections 30 which is adjacent the printed circuit board.

The fact of contact being made with the earth conductors on the printed circuit board by means of the contact areas 28 of the mounting part 10 produces locally defined points of electrical contact giving correspondingly defined paths for the flow of current regardless of the tin-lead solder, which may spread in unpredictable ways during the soldering process. This latter would occur if the printed-circuit-board side 16 of the first wall 14 were to form a completely flat surface resting on the printed circuit board.

The mounting part 10 has, on the side-pieces 20, at least one pin 46 (four are shown in the illustrative embodiment) which projects towards the printed circuit board, to engage in a corresponding mounting opening in the printed circuit board and to make a mechanical and/or electrical connection to the printed circuit board.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A multiple plug-in connector for printed circuit boards for fastening to a printed circuit board, including a mounting part and having at least two contact sections which each including a plug-in part for connection by plugging-in to a complementary mating part of a plug-in connector, an opening being formed for each contact section in the mounting part and each contact section passing through one of the openings by its plug-in part and being fastened to the mounting part mechanically, each contact section having, on a side adjacent the printed circuit board, at least one contact member for making electrical contact with a conductor on the printed circuit board, the mounting part including at least one first contact device which is so arranged and formed that said first contact device makes physical and electrical contact with the at least one contact member of the contact section, the mounting part including at least one second contact device which is electrically connected to at least one first connecting device and which is designed to make electrical contact with a conductor on the printed circuit board, such that the second contact device of the mounting part is so arranged and formed that said second contact device makes electrical contact with that conductor on the printed circuit board which has to be electrically connected to that contact member of the contact section which is electrically connected to that first contact device which is electrically connected to said second contact device.

2. The multiple plug-in connector of claim 1, wherein the contact section comprises an RF plug-in connector having an outer conductor and a center conductor, at least one contact member of the contact section including an outer-conductor contact and at least one other contact member of the contact section including a center-conductor contact.

3. The multiple plug-in connector of claim 2, wherein the first contact device of the mounting part is electrically connected to all the outer-conductor contacts of the contact sections, and the second contact device, which is connected to the first contact device, is in electrical communication with an outer conductor on the printed circuit board.

4. The multiple plug-in connector of claim 1, wherein the first contact device includes a clamped contact.

5. The multiple plug-in connector of claim 4, wherein contact areas of the clamped contact are coated with nickel.

6. The multiple plug-in connector of claim 1, wherein the second contact device of the mounting part includes a plurality of individual elevations which are formed on the side of the mounting part adjacent the printed circuit board and spaced apart from one another.

7. The multiple plug-in connector of claim 1, wherein the contact areas of the second contact device of the mounting part have a finish of tin.

8. The multiple plug-in connector of claim 1, wherein the mounting part comprises a stamped/punched and bent part.

9. The multiple plug-in connector of claim 1, wherein the mounting part comprises a zinc die casting.

10. The multiple plug-in connector of claim 1, wherein the first or second contact device, or both, of the mounting part are integral with the mounting part.

11. The multiple plug-in connector of claim 1, wherein the mounting part comprises, on a side adjacent the printed circuit board, at least one pin which projects from this side, to engage in a corresponding mounting opening in the printed circuit board and to make a mechanical, electrical, or mechanical and electrical connection to the printed circuit board.

12. The multiple plug-in connector of claim 1, wherein the mounting part includes a fastening portion to connect the mounting part mechanically to the printed circuit board.

13. The multiple plug-in connector for printed circuit boards according to claim 12, wherein the fastening portion includes an opening which is designed to have a screw screwed into the printed circuit board pass through it.

14. A printed circuit board having an electronic circuit and having a multiple plug-in connector for printed circuit boards which is arranged on the printed circuit board and which is electrically connected to the electronic circuit, wherein the multiple plug-in connector is designed in accordance with claim 1.

15. The printed circuit board of claim 14, wherein the multiple plug-in connector for printed circuit boards is screwed solidly to the printed circuit board.

16. The multiple plug-in connector of claim 3, wherein the first contact device includes a clamped contact.

17. The multiple plug-in connector of claim 4, wherein the second contact device of the mounting part includes a plurality of individual elevations which are formed on the side of the mounting part adjacent the printed circuit board and spaced apart from one another.

18. The multiple plug-in connector of claim 4, wherein the contact areas of the second contact device of the mounting part have a finish of tin.

19. The multiple plug-in connector of claim 5, wherein the contact areas of the second contact device of the mounting part have a finish of tin.

20. The multiple plug-in connector of claim 19, wherein the mounting part comprises a zinc die casting.

21. The multiple plug-in connector of claim 17, wherein the first or second contact device, or both, of the mounting part are integral with the mounting part.

22. The multiple plug-in connector of claim 16, wherein the mounting part comprises, on a side adjacent the printed circuit board, at least one pin which projects from this side, to engage in a corresponding mounting opening in the printed circuit board and to make a mechanical, electrical, or mechanical and electrical connection to the printed circuit board.

23. The multiple plug-in connector of claim 17, wherein the mounting part comprises, on a side adjacent the printed circuit board, at least one pin which projects from this side, to engage in a corresponding mounting opening in the printed circuit board and to make a mechanical, electrical, or mechanical and electrical connection to the printed circuit board.

24. The multiple plug-in connector of claim 16, wherein the mounting part includes a fastening portion to connect the mounting part mechanically to the printed circuit board.

25. The multiple plug-in connector of claim 17, wherein the mounting part includes a fastening portion to connect the mounting part mechanically to the printed circuit board.

26. The multiple plug-in connector for printed circuit boards according to claim 16, wherein the fastening portion includes an opening which is designed to have a screw screwed into the printed circuit board pass through it.

27. The multiple plug-in connector for printed circuit boards according to claim 17, wherein the fastening portion includes an opening which is designed to have a screw screwed into the printed circuit board pass through it.

* * * * *